United States Patent [19]

Wagenseil

[11] 4,033,238

[45] July 5, 1977

[54] AXIAL PISTON MACHINE WITH A TILTABLE, REVOLVING CYLINDER DRUM

[75] Inventor: Ludwig Wagenseil, Vohringen, Germany

[73] Assignee: Hydromatik GmbH, Germany

[22] Filed: Feb. 11, 1976

[21] Appl. No.: 657,151

[30] Foreign Application Priority Data

Mar. 26, 1975 Germany ..... 2513549

[52] U.S. Cl. ..... 91/505

[51] Int. Cl.[2] ..... F01B 13/04

[58] Field of Search ..... 91/487–489, 91/504–506

[56] References Cited

UNITED STATES PATENTS

| | | | |
|---|---|---|---|
| 2,313,407 | 3/1943 | Vickers et al. | 91/505 |
| 2,871,798 | 2/1959 | Thoma | 91/505 |

FOREIGN PATENTS OR APPLICATIONS

| | | | |
|---|---|---|---|
| 2,313,575 | 10/1974 | Germany | 91/504 |
| 345,534 | 5/1960 | Switzerland | 91/485 |

*Primary Examiner*—William L. Freeh
*Attorney, Agent, or Firm*—Owen, Wickersham & Erickson

[57] ABSTRACT

An axial piston machine has a central bore connected via a connecting duct with the pressure carrying duct of a mirror member. The central bore together with the central pivot acts as a pressure cylinder which exerts a central bearing pressure on the cylinder drum and the mirror member and acts against lifting forces which threaten to lift the mirror member off its slideway. With this additional force it is possible to enlarge the orifices or slots on the rear side of the mirror member so that the area of tilt of the cylinder drum with the mirror member is enlarged. The additional central bearing force applied by the present invention is supported on the drive flange via the central pivot and urges the mirror member against the slideway so as to ensure at all times a secure engagement of the mirror member even when the pressure sides change, that is, a changing direction of tilt of the cylinder drum in a reversing pump.

4 Claims, 5 Drawing Figures

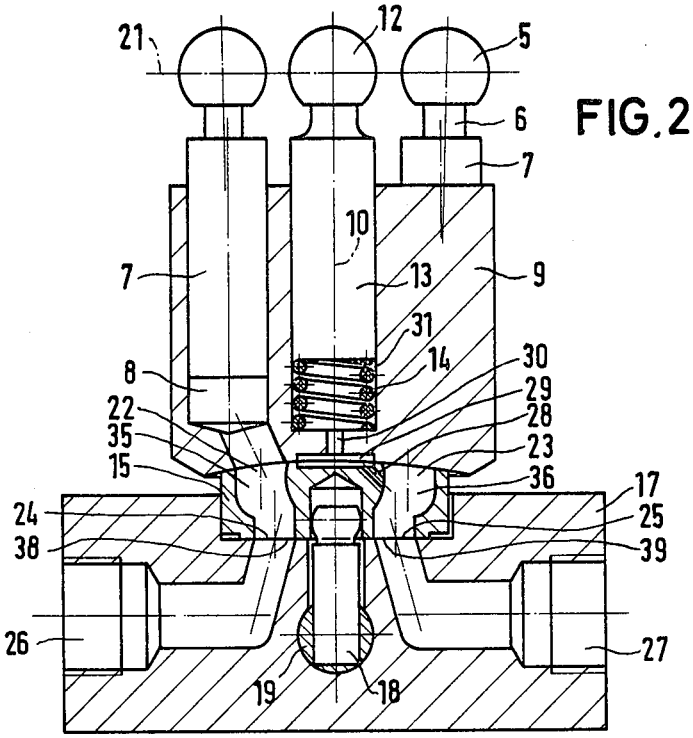
FIG. 2
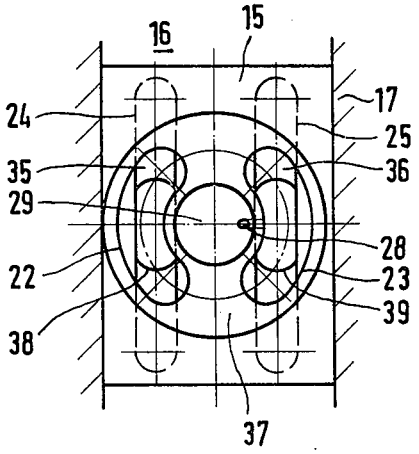
FIG. 3
FIG. 4
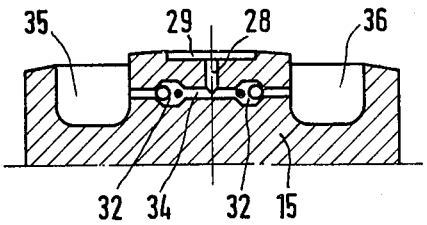
FIG. 5
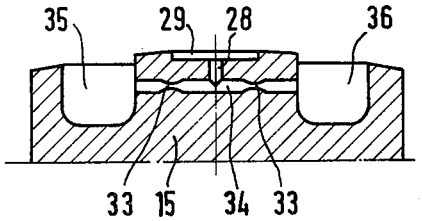

AXIAL PISTON MACHINE WITH A TILTABLE, REVOLVING CYLINDER DRUM

BACKGROUND OF THE INVENTION

The invention relates to an axial piston machine with a tiltable, rotating cylinder drum and a drive-connected drive pulley stationarily supported in a casing, pistons movable in cylinder bores of the drum being articulated to the drive pulley via ball and socket joints, and with a control mirror member with control ports (reniform) which face the outlets of the cylinder bores, the control mirror member being tiltable by an adjusting device to adjust the stroke of the pump, and whose cylinder surface shaped rear side facing away from the control mirror is supported on a suitably shaped slideway of the casing which has orifices connected with suction and pressure ducts for the pressure medium, the orifices being connected via ducts with the reniform control ports in all positions of tilt of the control mirror member, as well as a central pivot supported on the drive pulley for centering the cylinder drum, the pivot extending in a central bore of the cylinder drum and supported against the cylinder drum via an intermediately located compression spring.

This type of machine has become known, for example, from German Laid-Open Application No. 2,313,575. They are particularly suitable for small scale closed drives and excell by a noiseless and low vibration running even at high pressures and speeds. However, limitations are imposed on the possible angle of tilt of the cylinder drum in relation to the axis of the drive shaft for adjusting the stroke of the pump. Since the orifices disposed in the slideway for the control mirror member (which orifices are connected with the suction and pressure ducts of the pump) must be in alignment with the ducts in the control mirror member over the entire range of tilt of the control mirror member (which ducts are connected with the reniform control ports), said orifices must simultaneously be sealed off by the mirror member in all its positions of tilt against the interior of the machine casing.

It would be possible to enlarge the mirror member in order to achieve covering over a larger range of tilt, but the fact that the compression forces acting on the rear side of the mirror member facing the slideway must not be greater than the forces which keep the mirror member in engagement with the slideway speaks against an enlargement of the orifices on the rear side of the mirror member. These forces are exerted by the pistons via the cylinder drum onto the control mirror, that is, on the front of the mirror member and, together with the slight forces, which are exerted by the pressure spring acting between the central pivot and the cylinder drum, prevent a lifting of the mirror member from the guide surface.

In the case of the construction which has become known from German Published Application 1,017,468, the lifting forces acting on the mirror member are compensated with the aid of rollers holding down the mirror member in the slideway. This is very expensive from the point of view of construction and leads to the danger of the mirror member becoming locked, particularly in the case of wider angles of tilt.

The problems of enlargement of the angle of tilt in these types of machines is dealt with in German Laid-Open Application No. 2,003,851. There, to control the lifting forces of the mirror member, an additional special support is provided for the cylinder drum. In order to prevent the orifices between the mirror member and the suction and pressure ducts from becoming too large, and in order to control the lifting forces and still ensure a sealing covering even at wider angles of tilt, an intermediate element is interposed between the mirror member and the casing or its slideway, intermediate conduits extending through said intermediate element and the latter being tilted along with the cylinder drum over a correspondingly narrow angle of tilt. This construction requires considerable structural expenditure and leads to the need for numerous additional sealing surfaces between machine parts which move in relation to each other and are under high pressure.

SUMMARY OF THE INVENTION

The underlying object of the invention is to improve an axial piston machine of the above-mentioned type in such a manner that, without substantial expenditure, the possible angle of tilt of the cylinder drum can be enlarged. It is particular object of the invention to enlarge the orifices or slots on the rear side of the mirror member which must be aligned in any position of tilt with the orifices to the suction or pressure duct in the slideway and cover the latter, without the danger of the mirror member being lifted off the slideway.

To solve this problem, in connection with an axial piston machine of the type described above, the central bore is connected via connecting duct with the pressure carrying duct in the mirror member. Thereby, the central bore together with the central pivot acts as a pressure cylinder which exerts a central bearing pressure on the cylinder drum and the mirror member and acts against lifting forces which threaten to lift the mirror member off its slideway. With this additional force it is possible to enlarge the orifices or slots on the rear side of the mirror member so that the area of tilt of the cylinder drum with the mirror member is enlarged. The additional central bearing force applied by the present invention is supported on the drive flange via the central pivot and urges the mirror member against the slideway so as to ensure at all times a secure engagement of the mirror member even when the pressure sides change, that is, a changing direction of tilt of the cylinder drum in a reversing pump.

A further advantage of the invention consists in that it becomes possible also to enlarge the control cross sections on the cylinder and on the associated mirror of the control mirror member (enlargement of the reniform control ports) which results in better technical data or lesser flow speeds of the medium at identical output and less noise.

German Published Application No. 1,003,040 discloses in an axial piston machine, a central pressure chamber connected with the pressure side of the machine with a contact pressure piston which joins the cylinder drum to the control mirror with considerable force. However, the pressure piston there is not supported by a central pivot on the drive pulley, but the pressure piston is pre-stressed in relation to the cylinder drum and thus cannot generate additional contact pressure forces for the mirror member against the casing.

In order to counteract the friction forces between the cylinder drum and the control mirror which are increased by the additional central contact pressure force, in a practical development of the invention, at least one pressure field is provided between the control mirror and the control surface of the cylinder drum axially symmetrically to the axis of rotation of the cylinder drum, which pressure field is connected with the connecting conduit. A corresponding relief effect may be achieved instead of the additional pressure field by enlarging the reniform control ports in the control mirror.

Further practical developments will be seen from the subclaims. Embodiments of the invention are described in greater detail by way of example hereinbelow in connection with the attached drawings.

BRIEF DESCRIPTION OF THE DRAWINGS

FIG. 2 is a section view along line I-I in FIG. 1;

FIG. 3 is a top view onto the control mirror member, seen from the side of the control mirror;

FIG. 4 is a section view of the control mirror member with connecting duct, and

FIG. 5 is a sectional view, corresponding to FIG. 4 of another embodiment.

DESCRIPTION OF THE PREFERRED EMBODIMENT

Figure 1:
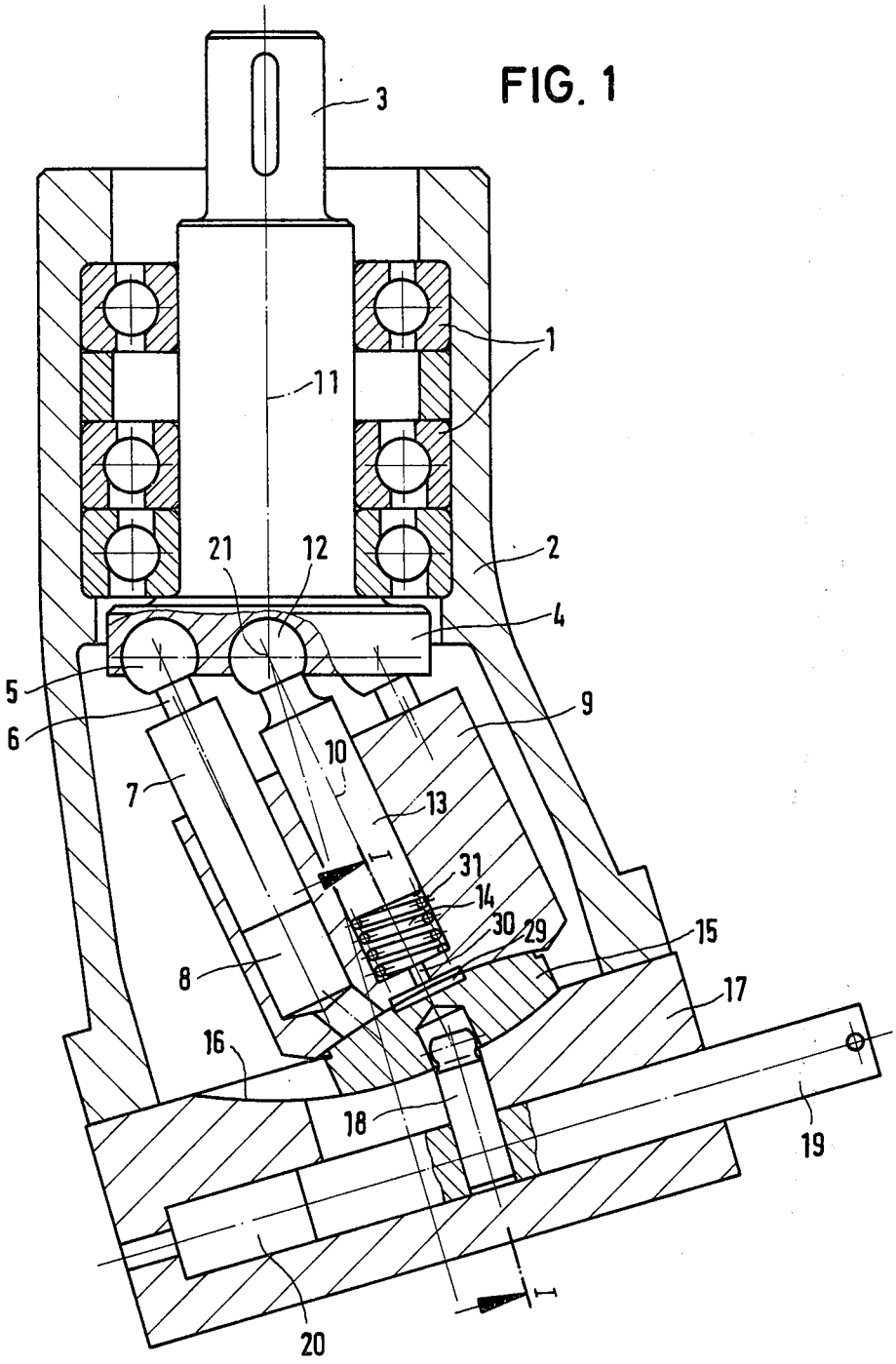
FIG. 1 shows schematically in section an axial piston machine constructed in accordance with one embodiment of the present invention.

The axial piston machine illustrated in FIG. 1 has a drive shaft 3 supported in a housing 2 via ball bearings 1, the drive shaft 3 carrying a drive plate 4. On the drive plate 4, the piston rods 6 of pistons 7 are supported via ball and socket joints 5. The pistons 7 move in cylinder bores 8 of a cylinder drum 9, which is set in rotational motion by the drive shaft 3 via the drive plate 4 and the pistons 7. The stroke of the pistons 7 depends on the angle of tilt formed by the cylinder drum axis 10 and the rotational axis 11 of the drive shaft 3. The cylinder drum 9 is centered in a central bore 31 by a central lug 13 supported by a ball 12 on the drive plate 4 and is supported—in the loaded condition of the machine under the effect of the oil pressure forces and in unloaded condition of the machine under the force of a compression spring 14 disposed between the central lug 13 and the cylinder drum 9—on a control mirror member 15 which in turn is supported on a cylindrical slidway 16 of the machine housing part 17.

For changing the angle of tilt, an adjustment lug 18 engages on the mirror member 15, the lug 18 being connected with an adjustment rod 19 which in turn is movably supported in a bore 20 in the machine housing part 17. An adjustment mechanism (not shown) engages the adjustment rod 19 and displaces the adjustment rod 19 in a longitudinal direction so that the lug 18 displaces the control mirror member 15 in the cylindrical slideway 16 while tilting the cylinder drum 9 about the axis of tilt 21.

As is seen in greater detail in FIGS. 2 and 3, feed and discharge ducts 35, 36 with reniform control ports 22, 23 are provided in the mirror member 15 in the control mirror 37 facing the cylinder drum 9, which on the rear side of the mirror member 15 change into slots 24, 25 whose length must be such that connection is ensured for the entire area of tilt of the cylinder drum 9, between the reniform control ports 22, 23 and the orifices 38, 39 of the suction and pressure ducts 26, 27 in the housing member 17.

The lengths of the slots 24, 25 which thus determine the maximal angle of tilt of the pump, are however limited by the oil pressure forces acting in them, and which seek to lift the mirror member 15 from its slideway 16.

In order to cure this deficiency, the invention provides for the pressure side (ducts 26, 35 and 27, 36) of the pump to be connected with the central bore 31 for the central lug 13, fluid admission to which generates a force acting against the lift-off oil pressure forces.

FIGS. 2 and 3 show a connecting conduit 28, which connects the duct 36, which is assumed to be the pressure side, with a pressure fluid 29 between the control mirror 37 and the cylinder drum 9, which in turn is connected, via a connecting conduit 30, with a bore 31 containing the spring 14 and the central lug 13. The bore 31 then acts as a pressure cylinder. It is, of course, possible to adapt the size and type of the pressure field 29 to varying requirements, for example there are cases in which no additional pressure field 29 is required when pressure admission and lubrication of the control mirror 37 is otherwise compensated, for example by enlarged reniform control ports 22, 23.

The cylinder bore 31 and the pressure field 29 in reversible pumps (tiltable to two sides) may be fed, for example, as shown in FIGS. 4 and 5, via check valves 32 or constrictors 33 in a connecting bore 34, so that the pump side which at the time carries the pressure, that is, conduit 35 or 36, is connected with a connecting conduit 28.

I claim:

1. An axial piston machine having a tiltable, rotating cylinder drum and a drive-connected drive pulley stationarily supported in a casing, pistons movable in cylinder bores of the drum articulated to the drive pulley via ball socket joints, a control mirror member with reniform control ports which face the outlets of the cylinder bores, the control mirror member being tiltable by an adjusting device to adjust the stroke of the pump, the control mirror member having a cylinder surface shaped rear side facing away from the control mirror and supported on a suitable shaped slideway of the casing, orifices in the slideway of the casing connected with suction and pressure ducts for the pressure medium, the orifices being connected via ducts with the reniform control ports in all positions of tilt of the control mirror member, a central pivot supported on the drive pulley for centering the cylinder drum, the pivot extending in a central bore of the cylinder drum and supported against the cylinder drum via an intermediately located compression spring and including connecting duct means extending from the pressure carrying duct through the mirror member and to the central bore for transmitting the pressure from the pressure carrying duct to the central bore and recess means between the cylinder drum and the mirror member providing a pressure field and a reaction surface on the mirror member on which the pressure in the central bore exerts a force in a direction to maintain the mirror member engaged with the slideway.

2. A machine as defined in claim 1, characterized in that the pressure field is provided between the control mirror and the control surface of the cylinder drum axially-symmetrically to the axis of rotation of the cylinder drum.

3. A machine as defined in claim 1, characterized in that a connecting bore with constrictors is provided within the mirror member between the suction-side and the pressure-side duct and the connecting duct means branches off between the constrictors toward the central bore.

4. A machine as defined in claim 1, characterized in that a connecting bore with check valves is provided within the mirror member between the suctionside and the pressure-side duct and the connecting duct means branches off between the check valves toward the central bore.

* * * * *